US009468828B2

(12) United States Patent
Bush

(10) Patent No.: US 9,468,828 B2
(45) Date of Patent: Oct. 18, 2016

(54) SYSTEM AND METHOD FOR A GOLF GAME

(71) Applicant: Shane Bush, Sherman Oaks, CA (US)

(72) Inventor: Shane Bush, Sherman Oaks, CA (US)

( * ) Notice: Subject to any disclaimer, the term of this patent is extended or adjusted under 35 U.S.C. 154(b) by 297 days.

(21) Appl. No.: 14/338,190

(22) Filed: Jul. 22, 2014

(65) Prior Publication Data

US 2016/0023073 A1 Jan. 28, 2016

(51) Int. Cl.
*A63B 67/02* (2006.01)
*A63B 57/00* (2015.01)

(52) U.S. Cl.
CPC ..... *A63B 67/02* (2013.01); *A63B 57/0056* (2013.01)

(58) Field of Classification Search
CPC ..... A63B 67/02; A63B 57/0556; A63B 24/0003; A63B 24/0006; A63B 2024/0009; A63B 2025/0015; A63B 63/00; A63B 2063/001; A63B 69/36; A63B 2069/3602; A63B 69/3614; A63B 69/3617; A63B 2069/362; A63B 69/3623; A63B 69/3658; A63B 2069/3626; A63B 69/3676; A63B 69/3679; A63B 69/3691
See application file for complete search history.

(56) References Cited

U.S. PATENT DOCUMENTS

| | | | |
|---|---|---|---|
| 4,281,834 | A | 8/1981 | Chavez |
| 4,326,717 | A | 4/1982 | McClimon |
| 4,413,827 | A | 11/1983 | Aberg |
| 4,460,177 | A | 7/1984 | Slayton |
| 4,928,973 | A | 5/1990 | Perry et al. |
| 4,988,105 | A | 1/1991 | Perry et al. |
| 5,213,330 | A | 5/1993 | Benson |
| 5,370,389 | A | 12/1994 | Reising |
| 5,419,561 | A | 5/1995 | Weber |
| 5,439,224 | A | 8/1995 | Bertoncino |
| 5,513,841 | A | 5/1996 | Takagi |
| 5,692,964 | A | 12/1997 | Smith et al. |
| 5,704,612 | A | 1/1998 | Kelly et al. |
| 5,860,648 | A | 1/1999 | Petermeier et al. |
| 6,458,035 | B1 | 10/2002 | Katayama |
| 6,592,473 | B2 | 7/2003 | McDonald et al. |
| 6,607,123 | B1 | 8/2003 | Jollifee et al. |
| 6,884,178 | B1 | 4/2005 | Frost |
| 6,973,491 | B1 | 12/2005 | Staveley et al. |
| 6,998,965 | B1 | 2/2006 | Luciano, Jr. et al. |

(Continued)

FOREIGN PATENT DOCUMENTS

WO WO-03/002209 A2 1/2003

OTHER PUBLICATIONS

International Search Report mailed Oct. 16, 2015, for PCT Application No. PCT/US15/41398, filed Jul. 21, 2015, two pages.

*Primary Examiner* — David L Lewis
*Assistant Examiner* — Matthew D Hoel
(74) *Attorney, Agent, or Firm* — Morrison & Foerster, LLP

(57) ABSTRACT

The present invention is directed to a system and method of golf-related leisure game. One or more targets is/are placed on an open playing field. Each target comprises a frame, a landing area, a lighting unit and a golf ball receptacle unit that contains a push solenoid and an illuminating photoelectric color sensor. Players of the game use standard golf clubs to strike the balls towards the target, wherein each player is assigned golf balls of distinct color. Players earn points by landing golf balls in the targets. Upon landing in the landing area of the target, the player's ball is fed into the receptacle unit. A color sensor within illuminates the received golf ball and measures the characteristics of the light reflected from its surface across three frequencies. The data from the color sensor is processed and, used for score keeping amongst the players.

20 Claims, 6 Drawing Sheets

(56) References Cited

U.S. PATENT DOCUMENTS

| | | | |
|---|---|---|---|
| 7,162,070 | B2 | 1/2007 | Furze et al. |
| 7,593,742 | B2 | 9/2009 | Bohnhoff |
| 7,771,776 | B2 | 8/2010 | Furze et al. |
| 2005/0269784 | A1 | 12/2005 | Peters |
| 2006/0012790 | A1 | 1/2006 | Furze et al. |
| 2006/0199658 | A1 | 9/2006 | Leonard |
| 2007/0262518 | A1 | 11/2007 | Lapinski et al. |
| 2012/0056721 | A1 | 3/2012 | Luciano, Jr. |

SYSTEM AND METHOD FOR A GOLF GAME

FIELD OF ART

The present invention is related to a system and method for a leisure game related to golf.

BACKGROUND OF THE INVENTION

The vast majority of golf-based country clubs charge an upfront fee to join and ongoing monthly dues which include use of the golf course and driving range. Public golf courses and driving ranges typically operate on a "pay as you play" model. They all rely on customer volume for profitability. The timing of customer volume is important. During times of the day when additional products and/or services are more likely to be consumed, customer volume is potentially more profitable. These times are typically lunchtimes and after 4 pm when there is a potential for additional revenue from the sale of food and beverages for example. Golf courses occupy large real estate footprints that often remain unused for the important parts of the day mentioned above.

The number of U.S. golfers has dropped 24 percent since 2002, losing over a million players in 2013 alone (source: "How Golf got Stuck in The Rough," *Bloomberg Business Week*, Jun. 23-29, 2014 at pp. 23-24). One of the reasons for the decreased popularity of golf is because of the time it takes to play an 18-hole golf course (approximately four hours) and the lack of mass social interaction. The decreasing in popularity of the game of golf is a problem that remains largely unsolved. As a result, in 2013 alone, almost 160 golf courses were shut down while only 14 new courses were opened (see Id.).

Driving ranges are an alternative to a round of golf, offering the opportunity to reduce the time spent on the activity. However, driving ranges present an inferior alternative to the game of golf. Specifically, while players can use driving ranges at any time of the day and there is no specific time-commitment, these facilities typically do not offer the environment of a competitive game and do not offer mass social interaction. Rather, a driving range is a facility where players practice golf-swing techniques. Although certain driving ranges provide targets on the range for practicing hitting at a designated target, there is typically not an installed score keeping system.

Certain driving ranges employ the use of radio frequency identification tags inside golf balls and associated antennas embedded within targets (RFID Systems). These systems track scores and enable players to compete with one another. These facilities often include integral bars and restaurants. They also require significant capital investments in real estate and are destinations in themselves, requiring complex infrastructure and specially manufactured golf balls. They are frequented by significant numbers of non or occasional golfers and do not directly facilitate in retaining existing golfers or encouraging new golfers for country clubs, golf courses or driving ranges. The disadvantage of these facilities is that they are purposely built infrastructures of their own, are not portable and hence cannot solve the footfall problems discussed above with respect to the traditional golf clubs.

In view of the above, it is an object of the present invention to provide a new and novel golf-related leisure activity system offering an enhanced golf-related experience while offering additional revenue potential for existing golf course, country club and driving range operators without any significant new capital investment. The present invention has also been designed to have a duration of play similar to that of other leisure activities: up to two hours. The set up and use of the preferred embodiment is designed to be efficient with most of the technology integral to the target and little or no infrastructure impeding the player's experience when checking in and hitting. In particular, the golf balls are intended to be standard other than being manufactured in specific colors. In this regard, it is an object of the present invention to re-create the experience of playing golf on a course or at a driving range with no additional equipment required by the players.

SUMMARY OF THE INVENTION

The present invention provides operators of a golf club (or other types of clubs or operations with suitable real estate) with an opportunity to leverage existing real estate. By making use of the holes near the club house and/or the driving range between late afternoon and early evening, the operator gains an opportunity for members to spend additional money including on profitable food and beverages, both during and after the event.

The preferred embodiment of the present invention is directed to a target-based system 10 and method of golf game using the same. According to a preferred embodiment of the present invention, the target-based system 10 includes one or more targets 20 that can be portably deployed. According to the preferred embodiment, each target comprises a frame 25, a landing area 27, and an under carriage 29, beneath the center 24 of which includes a golf ball receptacle unit 30 comprising ball positioning, identification and ejection components, and a ground support fixture 28.

In the preferred embodiment, the golf ball receptacle unit 30 preferably includes a platform component 37 having in part a depression for the golf ball to come to rest at a specific position relative to an illuminating photoelectric color sensor 35 and a push solenoid 32 or other resistive ejecting mechanism capable of ejecting the golf balls 34 once the color sensor has measured and transmitted the data for the golf ball in the golf ball receptacle unit, making way for the next golf ball in the queue. The color sensor acquires data pertaining to the relative components of red, green and blue wavelengths of light reflected from the golf ball (RGB or RGB values) when white light is shone at it. According to the preferred embodiment, the color sensor can measure RGB values of the reflected light from the golf ball in the receptacle in sufficient resolution to enable subsequent processing to discriminate between at least 15 different colored golf balls 34 which may be in play. According to the preferred embodiment, each of the golf balls is associated with a pre-assigned RGB identification profile (RGB ID). As specifically described in the DETAILED EMBODIMENT OF COLOR SENSOR AND METHOD FOR IDENTIFICATION OF RGB ID section, the RGB ID is preferably based on formulae created to use the data measured by the color sensor, the RGB values, in a way so as to enable each of the chosen colors to be uniquely identified from each other. The computations may be completed either within the color sensor itself, a processor operatively coupled to the sensor, and/or by a remotely connected managing computer 12.

According to a preferred embodiment, the RGB values from the color sensor are communicated to the managing computer 12 where the RGB ID is determined. Subsequently, scores and other game management functions may be stored and applied in accordance with the various games and for managing the presentation interface 13 with the players and spectators 14. Specifically, one key function is the tallying and accumulation of scores and their allocation to those players assigned specific colored golf balls during the game.

According to one embodiment, the game is a scoring game played among individuals and/or teams. Each individual and/or team is provided with and assigned to a certain number of golf balls of a specific color, and therefore RGB ID, at the beginning of the game. When those balls are identified by the color sensor located within the receptacle of a target. Positive identification of RGB ID data can be used during the game for purposes of management and keeping score. Scores are accumulated when players successfully hit their golf balls into the distant targets. Targets can be located at different places on the playing area based upon the degree of difficulty (distance and target size being the primary variables). According to one embodiment, as a golf ball RGB ID is determined by the data measured via the color sensor, the color sensor is also associated with a specific target to enable the target's size and location to be incorporated into the scoring. Targets that are smaller and/or further away may score higher points than those larger or closer.

According to the preferred embodiment, the present system of golf game can be played with regular, unmodified golf clubs and standard design, albeit specifically colored, golf balls.

According to yet a further embodiment, the tallied score can be contributed to a leaderboard in a competition setting, wherein the leaderboard can be embodied as an on-line competition between different players playing from different physical locations. According to one embodiment, access to the leaderboard can be made from mobile communication devices, such as a smart phone, tablet, or other mobile computing devices.

According to yet a further embodiment, the functions of the game may be switched off and the system used for target practice with the only information returned to the player being conformation a ball landed in the target in the form of the LED lighting illuminating at the target.

According to yet a further embodiment the same concept and design can be adopted for permanent installations using harder wearing materials.

DETAILED DESCRIPTION OF THE INVENTION

The preferred embodiments of the present invention will be described herein with references to FIGS. 1-5.

Overview of the System

In accordance with a preferred embodiment, different but specifically colored golf balls (further described in PREFERRED EMBODIMENT OF THE GOLF BALLS) that are plain and uniform in color and preferably without any text, pictures or logos on them can be assigned to individual players or teams for the duration of the game. The different colored golf balls are preferably selected not according to their color as seen by the naked eye but according to their ability to be uniquely identified by processing the RGB values measured by the color sensor 35.

As further discussed below, each of the golf balls in play can be identified according to its RGB ID. The RGB ID for each colored golf ball is a set of empirical and derived data ranges which enables each golf ball in play to be identified from the RGB values measured by the color sensor. The color sensor operates by measuring RGB values of light reflected from the golf ball that is illuminated by a beam of white light shone at a uniform intensity covering a specific area on the surface of the golf ball. The RGB values are communicated as representative voltages or currents. According to the preferred embodiment, the color sensor readings, the RGB values, are not only used to identify the golf balls in play, but also to identify the individual target the golf ball landed in, and also to control what color a LED lighting system on the edge of the target frame lights up in to indicate a golf ball hit a given target. This latter function provides players and spectators with a response from the playing field to add to the experience.

Figure 1:
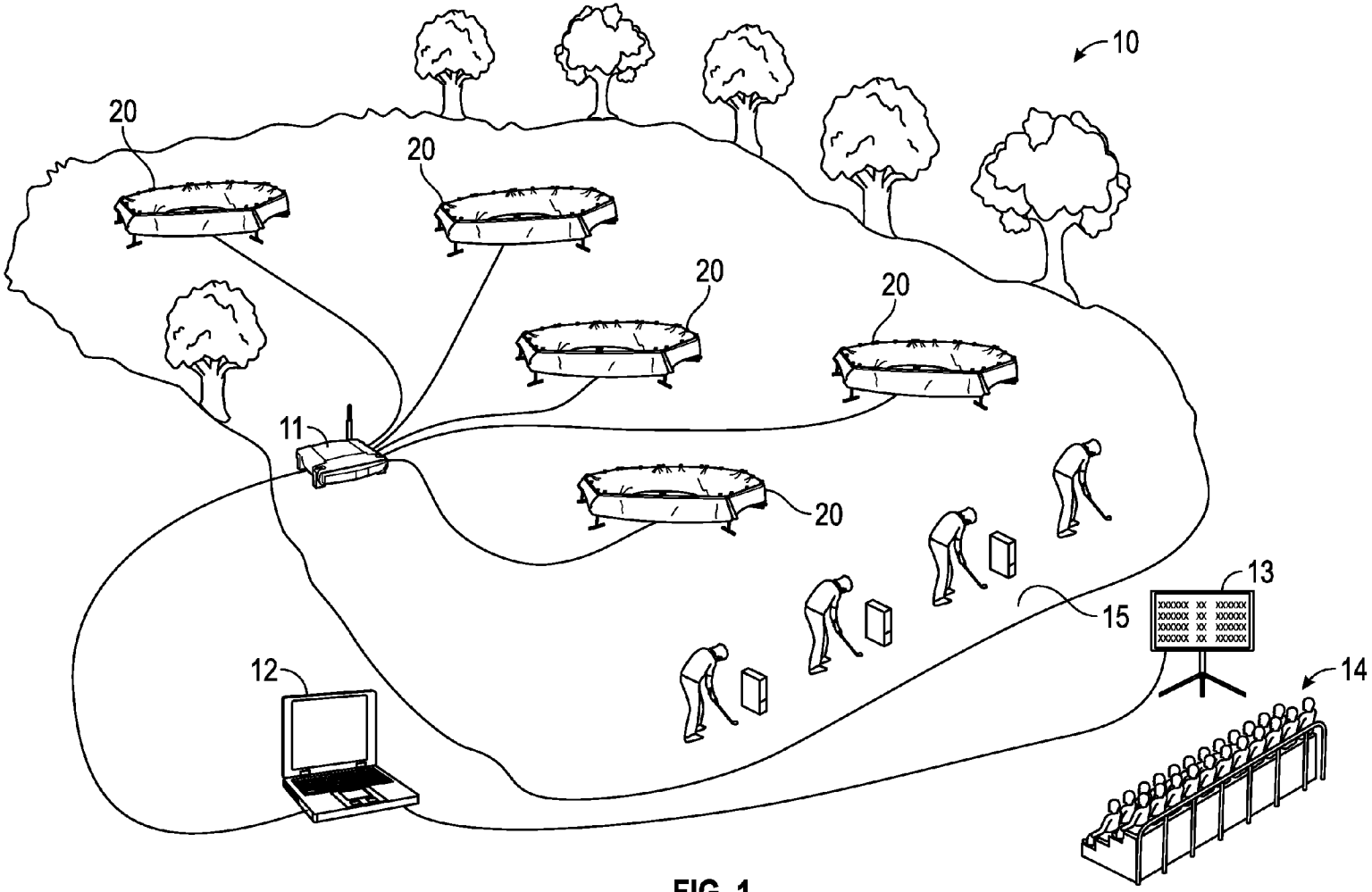
FIG. 1 is a schematic perspective drawing of a preferred embodiment of the present invention as installed on a playing field.

FIG. 1 schematically illustrates the preferred embodiment of the present invention as deployed on a playing field, such as a golf course. As shown in FIG. 1, targets 20 are placed on a playing field 10. According to a preferred embodiment, targets 20 can measure up to 900 square feet in surface area (when measured on the horizontal plane), placed at a distance of up to 300 yards from a hitting area such as the tee of a golf course. In the preferred embodiment, the targets are octagonal but further embodiments could have different shapes including circular. The purpose of the target frame is to provide stability and to ensure the relief of the surface of the landing area facilitates the golf ball funneling towards the center. FIG. 1 further shows a data log collector 11 that is connected to the various targets; the data log collector is in turn connected to a remotely connected managing computer terminal 12 that communicates with a billboard or display device 13, viewable by spectators 14. Although FIG. 1 illustrates a preferred embodiment with hard wired connections, it should be understood that other forms of connections are contemplated in the present invention, including the use of wireless communications connectivity. In accordance with an alternative embodiment, a data log collector 11 is not required, and the targets can transmit information to the managing computer directly. Additionally, although FIG. 1 illustrates only one display device 13, it should be understood that the present invention contemplates other possible ways of displaying or delivering scoring and/or ranking data, including transmitting such information to handheld devices or other computer terminals for display.

The landing area 27 of the target preferably includes a sheet of flexible sheeting material (plastic, vinyl or canvas for example) that can be attached to the frame and preferably forms a convex or bowl shape. The edges of the landing area and frame form in such a way as to help prevent golf balls from leaving the target once landed as shown schematically in FIG. 2B.

Attached to the underside of the center of the landing area is the under carriage 29. This is a preferably circular sleeve containing a shallow plastic funnel with a hole at the center of preferably eight inches or less. This part of the target collects golf balls falling through the center of the landing area and facilitates the funneling of the golf balls into the golf ball receptacle unit 30 that attaches to the under carriage's central hole at the end of its funnel.

A golf ball receptacle unit preferably comprises of reducing diameter funnel 36 fitted to the funnel of the under carriage to guide the golf ball into a delivery tube 31. The delivery tube has an internal diameter preferably slightly greater than the external diameter of a golf ball. It enables multiple golf balls which land in the target to form into a queue for sequential measurement by the color sensor 35. The receptacle further comprises a push solenoid. The push solenoid 32 is signaled by the managing computer at the desired time to eject the golf ball most recently measured, to be replaced by the next golf ball in the delivery tube.

The RGB values from the color sensor 35 can be processed at the target itself, or be transmitted (either wirelessly or through cables) to a central location for processing, storage and/or display by the managing computer and peripheral displays. The displays preferably include a main screen visible to players and the host person and additional displays throughout the spectators' area(s). The scoring information is preferably made accessible to mobile devices and through internet or intranet access. Data will be stored as required on a server or on a cloud based system.

Preferred Embodiment of the Golf Balls

The golf balls 34 compatible with the preferred embodiments of the present invention are preferably standard design range balls or higher quality branded golf balls without markings. Standard golf balls have diameter of approximately 1.68 inches. The colors of the golf balls are preferably selected to reduce errors in the identification of each RGB ID by the color sensor 35. Preferably, at least 15 uniquely identifiable RGB IDs are pre-assigned to different colored golf balls. Given the color sensor measures the RGB values of light reflected from the golf balls, the colors have been selected based on those RGB values and data derived from them, rather than what appears easily identifiable by the naked eye. In accordance with a preferred embodiment, the colors of a set of 15 different RGB IDs can be selected using a table such as shown below as a starting point. The values in the table use a relative scale of 0-100.

In accordance with the preferred embodiment, two of the colors currently selected for use in the game are dark green and fluorescent green. In the above table they correspond closely to color 27 and between color 5 and 16 respectively. Given fluorescent green falls between color 5 and 16, in choosing this color we are eliminating both color 5 and 16 from future color selection. This is mentioned as an example because the actual selection only starts with the above table. Further elimination of colors occurs based on testing of the actual performance of the golf ball receptacle unit and color sensor 35 based on the procedure described in PREFERRED EMBODIMENT OF COLOR SENSOR AND METHOD FOR IDENTIFICATION OF RGB ID. For a given color of golf ball, the RGB values as measured by the color sensor 35 will be different each time. This due a number of reasons, the main ones being a follows:

- The presence of dimples on the surface of the golf ball causes the reflective surface of the golf ball relative to the color sensor to be randomly variable within limits.
- Slight variations in the position the golf ball settles in the receptacle introduce random variations in the distance and reflective surface of the golf ball relative to the color sensor.
- Inconsistencies in the dimple design and manufacturing imperfections in the shape and relief of the golf ball cause random variations in the reflective surface of the golf ball relative to the color sensor.
- Manufacturing inconsistencies in the color of similarly colored golf balls.
- Changes to the ambient light conditions.

In order to reduce the variations described the golf balls are specified to have consistent dimple designs and color, and are sourced from as few numbers of manufacturing batches as possible.

Preferred Embodiments of the Target

Figure 2A:
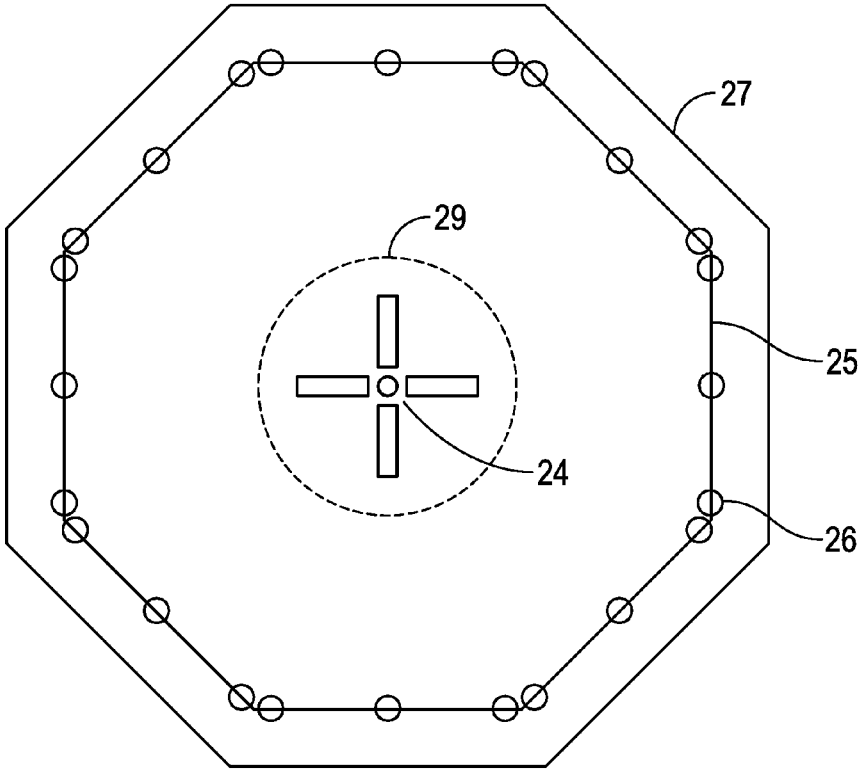
FIG. 2A is a schematic top view of a target frame and landing area in accordance with a preferred embodiment of the present invention.
Figure 2B:
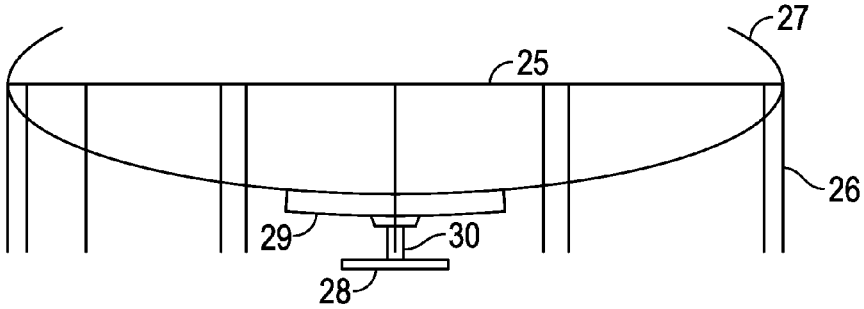
FIG. 2B is a schematic side view of a target in accordance with a preferred embodiment of the present invention.

FIGS. 2A and 2B illustrate the target in a preferred embodiment of the present invention.

With reference to FIGS. 2A and 2B, a target 20 comprises a target frame structure 25, a plurality of legs 26 that support the frame structure, a landing area 27, an under carriage 29, a golf ball receptacle unit 30 and a ground support fixture 28. The center of the landing area 24 is, in the preferred embodiment, attached to the ground support fixture by metallic wires. In an alternative embodiment, the under carriage 29 is attached to the ground support fixture by metallic wires.

| Color | 1 | 2 | 3 | 4 | 5 | 6 | 7 | 8 | 9 | 10 | 11 | 12 | 13 | 14 |
|---|---|---|---|---|---|---|---|---|---|---|---|---|---|---|
| Red | 100 | 100 | 100 | 50 | 100 | 100 | 0 | 100 | 0 | 0 | 100 | 50 | 50 | 100 |
| Green | 100 | 100 | 50 | 100 | 100 | 0 | 100 | 0 | 100 | 0 | 50 | 100 | 50 | 50 |
| Blue | 100 | 50 | 100 | 100 | 0 | 100 | 100 | 0 | 0 | 100 | 50 | 50 | 100 | 0 |

| Color | 15 | 16 | 17 | 18 | 19 | 20 | 21 | 22 | 23 | 24 | 25 | 26 | 27 |
|---|---|---|---|---|---|---|---|---|---|---|---|---|---|
| Red | 100 | 50 | 0 | 50 | 0 | 50 | 0 | 50 | 50 | 0 | 0 | 0 | 0 |
| Green | 0 | 100 | 100 | 0 | 50 | 50 | 50 | 0 | 50 | 0 | 50 | 0 | 0 |
| Blue | 50 | 0 | 50 | 100 | 100 | 50 | 50 | 50 | 0 | 50 | 0 | 50 | 0 |

The tables above show 27 different sets of RGB values. The actual number of colors chosen for use in the game depends on the ranges of RGB values each color of golf ball demonstrate during testing and calibration. Some colors have been rejected as they are not consistently uniquely identifiable using the methodology described in this invention.

In accordance with a preferred embodiment, once a ball lands on the landing area of the target, the ball travels under the influence of gravity towards the center 24. The under carriage is approximately six feet in diameter and is attached to the underside of the landing area so that the slits 23 near the landing area center are contained within the area of the under carriage. This prevents golf balls travelling at high speed through the slits, such as with a direct hit, to remain contained within the target and ultimately reach the golf ball receptacle unit and the color sensor 35.

The landing area is preferably constructed of soft material such a canvas, vinyl or plastic sheet the edges of which can attach from the frame in a manner preferably resulting in a smooth convex bowl shape. The under carriage preferably composes a circular sleeve attached to the underside of the landing area, and made of the same material as the landing area. Within the sleeve is a shallow plastic funnel of similar diameter. Both sleeve and funnel have a central hole. The center of the funnel protrudes through and below the sleeve and enables the top of the golf ball receptacle unit to operatively attach.

Slits 23 can be situated surrounding the center of the landing area 24 and allow the golf ball's travel to the under carriage. When the target is situated on sloping ground in the preferred embodiment, a different landing area may be used on the same target frame and golf ball receptacle unit. This would be similar to the one described only the slits 23 would be cut nearer one edge of the frame, again at the lowest point allowing for the slope. The under carriage 29 would also be moved to remain properly positioned below and covering the slits. The golf ball receptacle unit would still attach to the underside of the plastic funnel situated within the sleeve of the under carriage.

In an alternative embodiment, the legs may be adjusted to offset the slope making the top of the frame remain in the horizontal plane. As shown in the figures, the targets 20 are preferably octagonal in shape. In accordance with an alternative embodiment, the targets can be circular or other shapes when viewed from above. In accordance with the preferred embodiment, the frames of the target stand approximately three to five feet high from the ground, depending on the evenness of the ground, with each leg of the target operatively and preferably detachably coupled to the frame of the target at or around a joint location. According to an alternative embodiment, the legs are preferably adjustable in height to account for any unevenness of the ground level. In both cases a person of ordinary skill in the art would understand how to construct target so as to adjust for different leg lengths.

In accordance with the preferred embodiment, the targets 20 are installed on the ground of the playing field and are constructed with "off the shelf" PVC pipe and fittings, as typically used in the plumbing industry. PVC material is typically cost efficient, light in weight, and is not easily damaged by moisture. In an alternative embodiment, the target frame is constructed with telescopic frame lengths to increase assembly efficiency. For a more permanent installation, metal (steel or aluminum) or other hard wearing material may be used in accordance with an alternative embodiment. In accordance with a preferred embodiment, the frame of a target has legs every two to six feet apart and attachment points for the landing area component every similar interval.

According to a preferred embodiment, the landing area 27 of the target can be up to 30' by 30' square and cut down to fit a target frame 25 of a smaller size. Riveted holes approximately 1.5 inches in diameter are cut inside the perimeter of the landing area material at regular intervals which enable it to be attached to the target frame by the holes fitting over the tops of the target legs 26 which protrude from the top of the frame at similar regular intervals. When attached to the target frame 25, the landing area material may form a convex or bowl like shape, the center 24 being the lowest point assuming the target is placed on level ground. This causes the golf balls to roll towards the center due to gravity. The center of the landing area is preferably at least 20 inches off the ground to allow sufficient space for the under carriage and golf ball receptacle unit 30 to fit underneath without impacting the functionality of the target.

In accordance with the preferred embodiment, the perimeter of the target 20 curves upwards at the edges and then over and inwards towards the center 24, as shown in FIG. 2B. This helps prevent golf balls landing with a shallow angle at high speed from exiting the landing area of the target.

In accordance with the preferred embodiment, a strip or other shaped string of LED lights, or other forms of illuminating source of light (not shown in the figures) approximately 12 feet long is attached to the leading edge of the target frame. According to the preferred embodiment, such an illuminating source can be controlled by a signal from the managing computer. In accordance with the preferred embodiment, the light frequency of the light emitted can approximately match the RGB value of the golf ball detected by the color sensor 35. This provides real-time feedback to the players without the need for looking at the screen and facilitates faster play and an added experience. In accordance with an alternative embodiment, additional LED light strips or other such illuminating light sources may be located at other such points to enhance the visual impact for players and spectators.

Preferred Embodiment of the Golf Ball Receptacle Unit

The golf ball receptacle unit 30 is located below and at the center of the under carriage 29, and houses the color sensor 35. See FIGS. 3A and 3B.

Figure 3A:
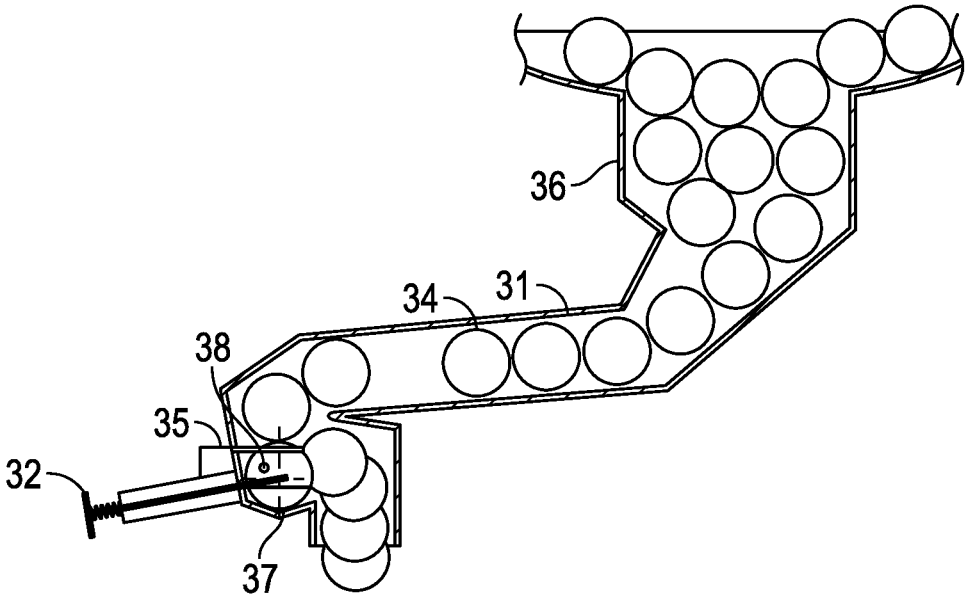
FIG. 3A is a schematic side view of a golf ball receptacle unit in accordance with a preferred embodiment of the present invention.

The receptacle unit 30 preferably comprises a hard plastic or metal frame, preferably of a darker color than the darkest color of golf ball used in the game. The following components are included:

- A funnel 36 of similar internal diameter at the top as the external diameter of the protruding center of the shallow funnel situated within the sleeve within the under carriage. This connection ensures golf balls are successfully collected from the under carriage and guided towards the color sensor's 35 location. The connection is a screw thread in the preferred embodiment. In an alternative embodiment it is a slotted connection or a hooked connection.
- A delivery tube 31 is attached to the output, preferably at the lowest point, of the funnel 36 with an internal diameter only very slightly larger than the external diameter of a golf ball. In accordance with a preferred embodiment, the tube is sufficiently long to contain up to six golf balls in a queue, sloping downwards at an angle appropriate to manage the speed of the golf balls as they approach the color sensor 35. FIG. 3A shows a schematic of a delivery tube 31 which is straight. The invention may use a curved delivery tube functioning the same way.
- A platform component 37 attached to the end of the delivery tube comprises a shallow circular depression. This causes the golf ball to come to rest at a specific position relative to the color sensor 35. The platform component also comprises an attachment point for the push solenoid 32, an attachment point for the color sensor, and a golf ball exit hole opposite the attachment point for the push solenoid.

In accordance with a preferred embodiment, the platform component and attachment supports for the color sensor and push solenoid are engineered so as not to move relative to each other. This part of the golf ball receptacle unit is, in the preferred embodiment of this invention, fashioned from a single piece of material. The color sensor 35 and push solenoid 32 preferably remain at a fixed point and orientation relative to the golf ball being measured. This reduces the range of RGB values for each golf ball and facilitates the availability of more unique RGB ID's.

Figure 3B:
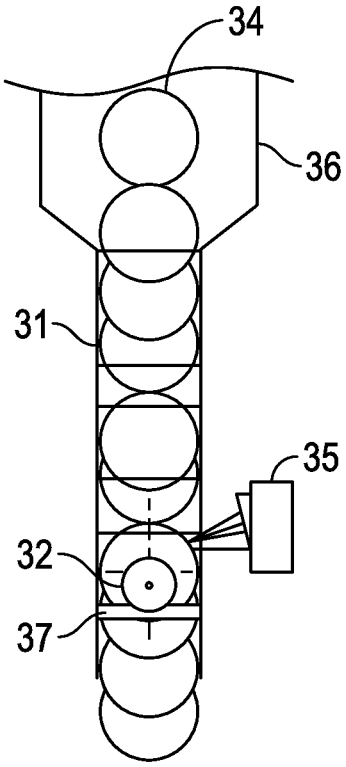
FIG. 3B is a schematic front view of a golf ball receptacle unit in accordance with a preferred embodiment of the present invention.

With reference to FIGS. 3A and 3B, the role of the golf ball receptacle unit 30 is to accept golf balls 34 from the under carriage above and guide them to rest at the required position relative to the color sensor 35 for identification. Following successful measurement of the RGB values of the golf ball, successful transmission of such values to the managing computer, and subsequent successful determination of the RGB ID, the managing computer signals for the golf ball to be ejected from the golf ball receptacle unit by the push solenoid, to be replaced by another golf ball if queued in the delivery tube.

In accordance with an alternative embodiment, RGB values and RGB ID from the color sensor 35 are transmitted to the managing computer. In this case, additional logic is built into the color sensor to calculate the RGB ID within the color sensor itself.

In accordance with the preferred embodiment, a bespoke color sensor 35 would be used with only the required functionality. A bespoke color sensor 35 is being designed currently. In an alternative embodiment, an "off the shelf" color sensor 35 sits within the receptacle unit. An example of such an off-the-shelf color sensor is a Tri-Tronics Colorwise SmartEye CW-1 which is currently being used. This sensor provides appropriate data but has capabilities not required for this application.

Below the platform component, where the golf ball being measured comes to rest, is a sleeve type connection. This connection fits snugly onto a short metallic tube connected to a heavy base plate 28. The heavy base plate sits on the ground (see FIG. 2B) and is similar to an outdoor umbrella stand and serves a similar purpose: to provide stability for the target and golf ball receptacle unit. It's weight adds tension to the landing area and helps to ensure the low point of the landing area and under carriage corresponds to the position of the entry point to the golf ball receptacle unit 36. This ensures all golf balls entering the target ultimately come to rest in the platform component of the golf ball receptacle unit and adjacent to the color sensor.

Preferred Embodiment of Color Sensor and Method for Identification of RGB ID

The type of color sensor 35 used in this invention measures electromagnetic wave characteristics in the visible spectrum (400 nm to 700 nm) of objects which do not emit their own light (such as a golf ball in this case). The golf ball is illuminated by shining white light onto it's surface, in the form of focused beam of uniform intensity and cross sectional area, from within the color sensor housing itself or from an adjacent position. The golf ball reflects some of this light and a portion of it passes through the color sensor's filters where the sensor determines the RGB values. The RGB values measured are typically transformed from RGB to XYZ according to the Commission Internationale d'Éclairage (CIE) defined standardized linear transformation method. The transformation is undertaken to make the data more easily usable in a variety of applications and most sensors have the formulae incorporated. It can also simply be undertaken by the managing computer according to standard formulae. The RGB and XYZ data have been collectively referred to as RGB or RGB values. The color sensor generates its signal for transmission to the managing computer 12 as either a representative voltage or current.

Figure 4:
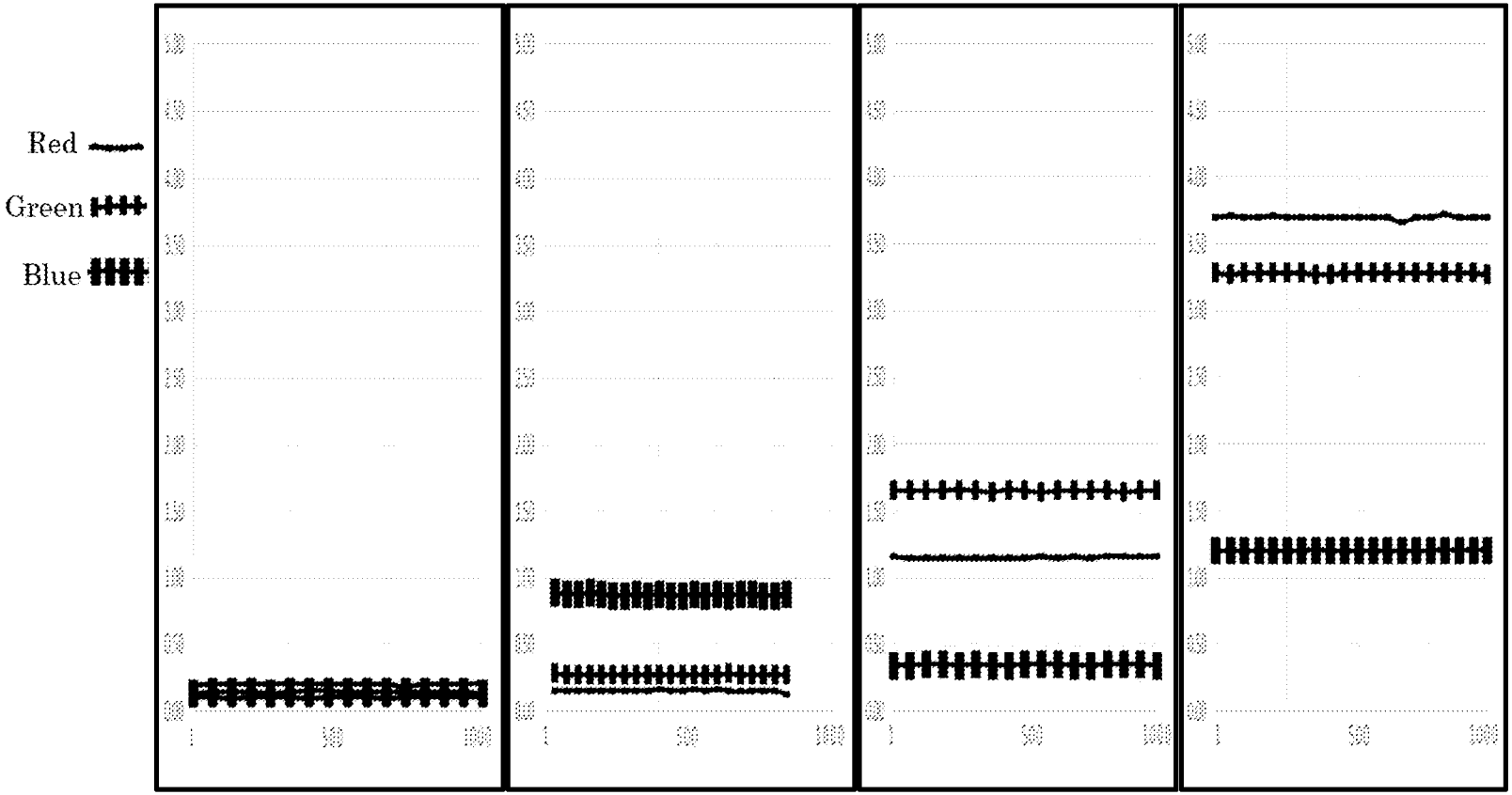
FIG. 4 is a set of comparison tables that illustrates the RGB values measured by the color sensor in accordance with the preferred embodiment of the present invention.

FIG. 4 is an illustration of over 800 sensor readings for each of a selection of golf ball colors. From left to right, the plots represent dark green, dark purple, orange and yellow, respectively. The plots show the differing magnitude of the signals from the color sensor (y-axis) for each of the three light wavelengths (Series 1-3 which represents the red, green and blue components) for the different colored golf balls. In this case they are displayed on a scale of 0-5 v which is consistent with the output of the color sensor 35 currently being used.

Figure 5:
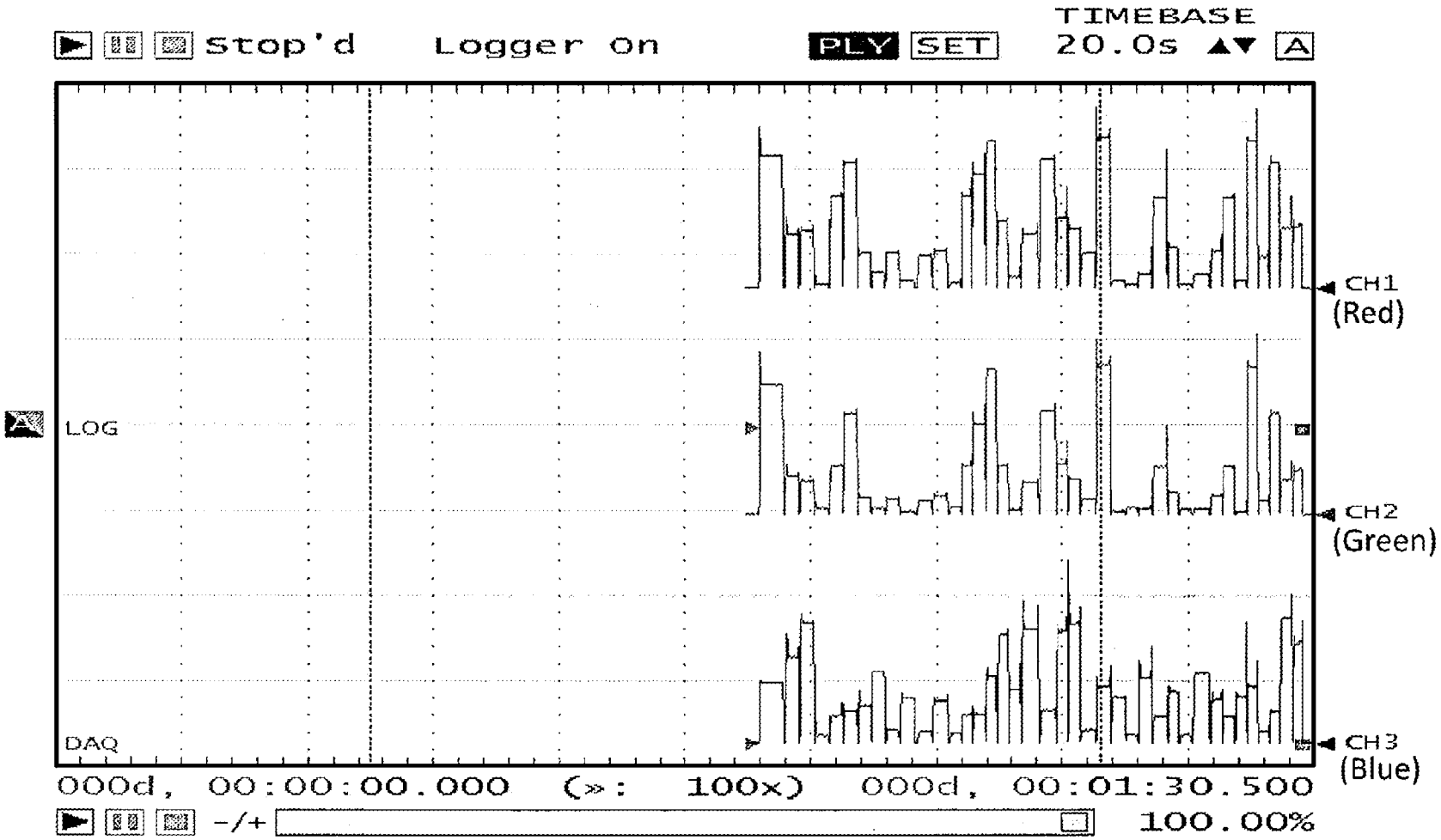
FIG. 5 is a plot graph that illustrates the identification process of a colored golf ball in accordance with the preferred embodiment of the present invention.

FIG. 5 is a plot of actual output from the color sensor with different colored golf balls passing the color sensor 35.

Golf balls have dimples which are uneven surfaces that introduce large deviations in the RGB values. Specifically, the presence of dimples on a golf ball means each time a golf ball comes to rest in the golf ball receptacle unit there is a slight random variation in the position of the dimples relative to the color sensor and the distance of the surface of the ball from the color sensor. Given the shape of the dimples and the area between them, these variations cause the intensity of light reflected and received at the color sensor to vary even when the golf ball is the same color. This is due to the curvature of the surface of a golf ball and the dimples causing the light to be reflected in different directions, and, therefore differing quantities of light being presented to the color sensor, for each measurement. Additional random variations result from imperfections to the finish of the surface of the golf balls from the manufacturing process and from use, variations in color among similarly colored golf balls, and the local ambient light variations. The random variations widen the range of RGB values measured by the color sensor. The combined effect of these variations reduces the number of uniquely colored golf balls and RGB IDs available for the present invention of the game.

In order to facilitate a competitive game amongst a sufficient number of different competitors, the present invention in accordance with a preferred embodiment, combines the color of the golf balls, the golf ball receptacle unit design, the color sensor and an appropriate algorithm to ensure it is capable of distinguishing between at least 15 RGB IDs.

To achieve this goal, the inventor conducted a series of experiments and has determined the optimal and range of positions on a golf ball where the white light can be shone and the range of distances between the color sensor 35 and the golf ball in order for these at least 15 different colored balls to be uniquely identified. Unique identifiers have been established for a range of colors including bright (fluorescent green for example) and dark ones (dark green for example).

Given the golf game is to be undertaken on a playing field and not in the lab, the golf ball receptacle unit design, the primary purpose of which is to bring the golf ball to rest at the correct position relative to the color sensor, ensures that the golf ball colors used can be correctly identified at the mid point of their respective RGB ID ranges. This then builds in the ability of the invention to function in the variable environment discussed. The precise numbers provided though out this section are provided as examples because they vary with the design of the golf ball's dimples and the color sensor's white light emitter. The golf ball receptacle unit requires calibrating for particular golf ball designs and color sensor. This ensures the shallow depression within the platform component where the golf ball comes to rest is adjusted to the correct position relative to the color sensor for each golf ball and color sensor design. Hence, in the preferred embodiment, the manufacturing design of the golf balls, color sensor and golf ball receptacle unit will remain consistent until they are improved collectively, from time to time. The actual RGB values and RGB IDs mentioned in this application have been determined for use with the color sensor currently being used: Namely a Tri-Tronics Colorwise SmartEye CW-1.

According to a preferred embodiment of the invention, the position of the center of the white light spot on the surface of the golf ball should preferably be between three and seven sixteenths of an inch offset both vertically and horizontally from the intersection of the vertical and horizontal axes passing through the center of the golf ball. A schematic of this position 38 is shown in FIGS. 3A and 3B. The width of the white light spot on the golf ball is preferably greater in diameter than the largest dimple. The distance, preferably between four and 12 sixteenths of an inch between the golf ball and the color sensor is determined by these two variables constrained by the design specifications of the color sensor itself.

The golf ball receptacle unit design is also required to facilitate measuring when no golf ball is in the receptacle. The color of the material in the line of the white light beam when no ball is present should preferably be black to enable this. In an alternative embodiment, part of the receptacle is cut away so that no light is reflected from the surface of the receptacle back to the color sensor when no golf ball is present in the receptacle.

According to a preferred embodiment, the color sensor, push solenoid, LED light strips and balance of power consuming infrastructure are powered by either mains electricity or 6-24 volts dc power from a battery pack which may be found in a standard golf cart.

The color sensor communicates data to the managing computer through an "off the shelf" data log collector 11 either wirelessly or through hard wires. The RGB ID data is also used to determine which color to light the LED strip on the leading edge of the target frame with a color matching that of the most recent golf ball to be detected in one of the targets. The signals for LED lights come from the managing computer through the same data log collector 11, or an additional one depending on commercial considerations.

In summary, the range of RGB values obtained during the experiments were and are used to determine the RGB ID of each color of golf ball considering all the variables seen to negatively impact their consistency. The actual color of the golf ball as seen by the naked eye is largely irrelevant within reason. The ability to create of a unique identifier, an RGB ID, for at least 15 different colors of golf balls is an objective of the present invention of the golf ball receptacle unit and algorithm for processing the RGB values.

To achieve the mid-point of the range of RGB IDs for each color golf ball and to successfully create at least 15 RGB IDs, the RGB ID's are required to be determined pursuant to four "reference light intensities", based on reading a control white or other bright colored golf ball and a dark green or other dark colored golf ball, which were established to cover the range of intensities seen to randomly occur, as discussed above, over thousands of readings. These experiments were performed by the inventor for each type of color sensor used, each color golf ball and for each dimple design to be entirely accurate and achieve the best results. The four reference intensities are named "High", "Medium high", "Medium low" and "Low". "Low" is defined as the lowest intensity at which the darkest of the colors can be repeatedly correctly and uniquely identified; in this case a dark green golf ball. "High" represents the highest intensity at which the brightest of the colors can be repeatedly correctly and uniquely identified; in this case a fluorescent green high visibility golf ball. The brightest color, white, is not used in the invention other than in the practice mode. The remaining two intensities fall in between "High" and "Low" and are selected to ensure there are no gaps in the resultant datasets which could allow an RGB Value (or subsequent processed data) to fall out of range within the "High" and "Low" parameters. The four reference intensities provide sufficient resolution across the range of RGB values measured to facilitate at least 15 uniquely identifiable RGB IDs to be determined.

In accordance with the preferred embodiment in which 15 color differentiations are achieved, a set of 60 unique identifiers, or RGB IDs, over four reference intensities have been created (4×15). This dataset allows a set of 15 different colored golf balls to be successfully and uniquely identified each time they land in the golf ball receptacle unit. The golf ball receptacle unit ensures the ball comes to rest at approximately the correct position relative to the color sensor, and the dataset and formulae described above corrects for the random variations discussed. This approach enables golf ball color recognition to be used in the real world and not only in the lab.

RGB IDs are datasets comprising RGB values and derived values created for each colored golf ball. The RGB values measured by the color sensor are processed and analysed against each reference intensity dataset separately. The analysis consists of magnitude range comparisons, ratio range comparisons, and pan intensity comparisons ("High", "Medium High", "Medium Low" and "Low") in order to decide if a RGB ID has been identified.

In the preferred embodiment, the RGB IDs are contained within a database in the managing computer. Each time a set of RGB values is received from the color sensor 35 by the managing computer 12, they are processed and compared with the database. As mentioned, the database consists of RGB ID data for four reference intensities. The RGB values must be compared to each reference intensity dataset independently in order to ensure no confusion between golf balls. For example a high intensity RGB ID for one color may overlap a low intensity RGB ID for another color in some cases and result in confusion. By comparing the RGB values with each reference intensity dataset independently, this trap is avoided. The results for the comparisons are then themselves compared to eliminate errors. For example if the RGB ID is consistent in the "High" and "Medium high" datasets it is likely to be accurate. If the RGB ID is inconsistent in the "High" and "Medium high" datasets it is likely to be inaccurate. If the RGB ID is consistent in the "High" and "Low" datasets it is likely to be inaccurate for some colors and not for others. The processor determines the likelihood of how accurate an identification of an RGB ID is and records the result accordingly.

According to the preferred embodiment, the technique for selecting the colors for the balls to be used in the game and subsequently identifying them by the color sensor 35 can be the same. Specifically, when choosing a color for a golf ball, it is tested against all the other golf balls selected for use to confirm a unique marker can be established. That marker is the RGB ID referenced herein. According to the preferred embodiment, three RGB values are measured by the color sensor 35 and processed based on comparing all three and the derived values against four "intensity" databases (Low, Medium Low, Medium High and High).

For each color golf ball, the database contains values for magnitude of each RGB Value, including the maximum and minimum measured over thousands of readings. The same set of data also contains the relative values of one against the other including the maximum and minimum measured over thousands of readings.

Given there are three RGB values, each of the four databases may contain three magnitude ranges (min. to max.) and also three ranges (min. to max.) for each of the RGB values relative the other in the form of a ratio. If one defines the three RGB values as red ("R"), green ("G") and blue ("B"), each database would contain the following data ranges comprising the RGB ID for each color:

Magnitude
Min R-Max R
Min G-Max G
Min B-Max B
Ratio
Min R/G-Max R/G
Min R/B-Max R/B
Min G/B-Max G/B These six ranges are identified for each "reference intensity"; Low, Medium Low, Medium High and High. Therefore, there are four different sets of the above six ranges making 24 ranges for each color. Those 24 ranges are effectively the RGB ID. Additional pan intensity comparisons complete the process of determining the RGB ID.

Each set of three RGB values sent to the managing computer is processed and compared to the four databases separately. If one of more of the databases returns a positive identification for a color, then a successful color match is made.

Given the databases are effectively differentiated by intensity, if a color is identified in adjacent databases (Low and Medium Low, or Medium Low and Medium High, for example) there is a high likelihood the positive identification is accurate. If a color is identified in say, the Low and High databases and not those in between, this is unusual and is likely to be inaccurate.

In accordance with the preferred embodiment, a requirement for a positive identification of RGB ID is that a color is identified in one, or, in the case of more, adjacent databases.

An example algorithm for color identification is provided below in accordance with the preferred embodiment, with the color sensor 35 RGB values sent to managing computer being R, G, and B, the four "intensity" databases in managing computer (Low, Medium Low, Medium High, High) being L, ML, MH, H, and the database data for each of four databases being Min G, Max G, Min R, Max R, Min B, Max B, Min R/G, Max R/G, Min R/B, Max R/B, Min G/B, and Max G/B:

Algorithm for Color Determination in Accordance with Preferred Embodiment:

If R>L(Min R) and R<L(Max R), and G>L(Min G) and G<L(Max G), and B>L(Min B) and B<L(Max B)
And If R/G>L(Min (R/G)) and R/G<L(Max (R/G)), and R/B>L(Min (R/B)) and R/B<L(Max (R/B)) and G/B>L(Min (G/B)) and G/B<L(Max (G/B))
Then L=1. Otherwise L=0.
If R>ML(Min R) and R<ML(Max R), and G>ML(Min G) and G<ML(Max G), and B>ML(Min B) and B<ML(Max B)
And If R/G>ML(Min (R/G)) and R/G<ML(Max (R/G)), and R/B>ML(Min (R/B)) and R/B<ML(Max (R/B)) and G/B>ML(Min (G/B)) and G/B<ML(Max (G/B))
Then ML=1. Otherwise ML=0.
If R>MH(Min R) and R<MH(Max R), and G>MH(Min G) and G<MH(Max G), and B>MH(Min B) and B<MH(Max B)
And If R/G>MH(Min (R/G)) and R/G<MH(Max (R/G)), and R/B>MH(Min (R/B)) and R/B<MH(Max (R/B)) and G/B>MH(Min (G/B)) and G/B<MH(Max (G/B))
Then MH=1. Otherwise MH=0.
If R>H(Min R) and R<H(Max R), and G>H(Min G) and G<H(Max G), and B>H(Min B) and B<H(Max B)
And If R/G>H(Min (R/G)) and R/G<H(Max (R/G)), and R/B>H(Min (R/B)) and R/B<H(Max (R/B)) and G/B>H(Min (G/B)) and G/B<H(Max (G/B))
Then H=1. Otherwise H=0.

Positive Identification of RGB ID

| Database name | L value (1/0) | ML value (1/0) | MH value (1/0) | H value (1/0) |
|---|---|---|---|---|
| L | 1 | 0 | 0 | 0 |
| L | 0 | 1 | 0 | 0 |
| L | 0 | 0 | 1 | 0 |
| L | 0 | 0 | 0 | 1 |
| L | 1 | 1 | 0 | 0 |
| L | 0 | 1 | 1 | 0 |
| L | 0 | 0 | 1 | 1 |
| L | 1 | 1 | 1 | 0 |
| L | 0 | 1 | 1 | 1 |
| ML | 1 | 0 | 0 | 0 |
| ML | 0 | 1 | 0 | 0 |
| ML | 0 | 0 | 1 | 0 |
| ML | 0 | 0 | 0 | 1 |
| ML | 1 | 1 | 0 | 0 |
| ML | 0 | 1 | 1 | 0 |
| ML | 0 | 0 | 1 | 1 |
| ML | 1 | 1 | 1 | 0 |
| ML | 0 | 1 | 1 | 1 |
| MH | 1 | 0 | 0 | 0 |
| MH | 0 | 1 | 0 | 0 |
| MH | 0 | 0 | 1 | 0 |
| MH | 0 | 0 | 0 | 1 |
| MH | 1 | 1 | 0 | 0 |
| MH | 0 | 1 | 1 | 0 |
| MH | 0 | 0 | 1 | 1 |
| MH | 1 | 1 | 1 | 0 |
| MH | 0 | 1 | 1 | 1 |
| H | 1 | 0 | 0 | 0 |
| H | 0 | 1 | 0 | 0 |
| H | 0 | 0 | 1 | 0 |
| H | 0 | 0 | 0 | 1 |
| H | 1 | 1 | 0 | 0 |
| H | 0 | 1 | 1 | 0 |
| H | 0 | 0 | 1 | 1 |
| H | 1 | 1 | 1 | 0 |
| H | 0 | 1 | 1 | 1 |

Below table shows six RGB color sensor 35 RGB values R, G and B, in two sets, when a yellow golf ball enters the golf ball receptacle and was measured by the color sensor 35. R/G, R/B and G/B are calculated and are on a scale of 0-5 v. RGB 1, 2 and 3 and RGB 4, 5 and 6 are from the same ball entering the golf ball receptacle on two occasions with no changes made to the ball, receptacle, color sensor 35 position or ambient light. This represents the type of variations seen in RGB values as discussed in this application.

| RGB no. | RGB Value R | RGB Value G | RGB Value B | R/G | R/B | G/B |
|---|---|---|---|---|---|---|
| RGB1 | 0.01 | 0.02 | 0.01 | 0.55 | 1.00 | 1.80 |
| RGB2 | 2.55 | 2.68 | 0.45 | 0.94 | 5.65 | 5.95 |
| RGB3 | 2.54 | 2.66 | 0.44 | 0.95 | 5.75 | 6.04 |
| RGB4 | 0.01 | 0.02 | 0.01 | 0.55 | 1.00 | 1.80 |
| RGB5 | 3.27 | 3.70 | 1.21 | 0.88 | 2.70 | 3.05 |
| RGB6 | 3.27 | 3.70 | 1.20 | 0.88 | 2.70 | 3.08 |

RGB1 and RGB4 show RGB values of close to 0 because no golf ball is in the receptacle.

The RGB ID for yellow and red are as follows for each of the databases L, ML, MH and H. Red is included to show how the two colors differ.

| Yellow | | | | |
|---|---|---|---|---|
| | L | ML | MH | H |
| Min R | 1.14 | 1.56 | 1.91 | 2.61 |
| Max R | 1.75 | 2.47 | 3.11 | 4.09 |
| Min G | 1.14 | 1.58 | 1.95 | 2.73 |
| Max G | 1.76 | 2.52 | 3.26 | 4.24 |
| Min B | 0.19 | 0.27 | 0.33 | 0.48 |
| Max B | 0.31 | 0.48 | 0.54 | 2.02 |
| Min R/G | 0.93 | 0.91 | 0.90 | 0.88 |
| Max R/G | 1.08 | 1.05 | 1.03 | 1.05 |
| Min R/B | 4.97 | 4.34 | 5.26 | 1.84 |
| Max R/B | 6.46 | 6.57 | 6.59 | 5.94 |
| Min G/B | 5.00 | 4.41 | 5.49 | 1.89 |
| Max G/B | 6.46 | 6.67 | 6.88 | 6.24 |

| Red | | | | |
|---|---|---|---|---|
| | L | ML | MH | H |
| Min R | 0.30 | 0.41 | 0.56 | 0.67 |
| Max R | 0.77 | 0.83 | 0.84 | 1.81 |
| Min G | 0.18 | 0.24 | 0.32 | 0.40 |
| Max G | 0.45 | 0.50 | 0.51 | 1.50 |
| Min B | 0.08 | 0.11 | 0.13 | 0.20 |
| Max B | 0.21 | 0.22 | 0.26 | 1.67 |
| Min R/G | 1.42 | 1.45 | 1.46 | 1.15 |
| Max R/G | 2.09 | 1.99 | 1.98 | 1.75 |
| Min R/B | 2.97 | 3.24 | 2.95 | 1.00 |
| Max R/B | 4.68 | 4.73 | 4.54 | 3.62 |
| Min G/B | 1.65 | 1.89 | 1.62 | 0.81 |
| Max G/B | 2.86 | 2.85 | 2.84 | 2.25 |

As can be seen above, RGB2 and 3 fall within the Min/Max R value for yellow in the MH database, but not for the others. A similar result is seen for G. B falls within the Min/Max B value for databases ML and MH. R/G falls in the range for all four databases. R/B for all four databases, and G/B for all four databases. In this example the only database where the RGB ID is identified is MH because this is the only database where all of R, G, B, R/G, R/B and G/B fall within their prescribed ranges.

Comparing the RGB Value with the red database reveals the value for B falls within the H database range. No other values fall within range. Red did not therefore result in a positive RGB ID identification across any of the four red databases. A positive identification did occur in the following part of the yellow MH database:

| Database name | L value (1/0) | ML value (1/0) | MH value (1/0) | H value (1/0) |
|---|---|---|---|---|
| MH | 0 | 0 | 1 | 0 |

The RGB ID would have been positively identified as yellow.

RGB 5 and 6 fall within the Min/Max ranges for R, G, B, R/G, R/B. G/B in the H database only.

Therefore a positive identification would occur in the following part of the yellow H database:

| Database name | L value (1/0) | ML value (1/0) | MH value (1/0) | H value (1/0) |
|---|---|---|---|---|
| H | 0 | 0 | 0 | 1 |

The RGB ID would also have been positively identified as yellow but from the H database, as opposed to the previous example where the RGB ID was identified from the MH database.

Given that the MH and H databases are adjacent in intensity, the golf ball would have been identified as yellow correctly.

It should be noted that as a golf ball arrives in the shallow circular depression of the platform component 37 adjacent to the color sensor 35 the ball is in motion. This motion causes huge variation in RGB values and need to be eliminated. Similarly the managing computer needs to recognize when no golf ball is adjacent to the color sensor 35. The former is achieved by eliminating, or cleaning, RGB values where previous values are different by a certain factor determined by the experiments. This causes only more consistent ranges of RGB values to be processed for determining an RGB ID. The preferred embodiment is the black background and the alternative embodiment is the hole in the receptacle.

Regarding cleaning of the RGB values, the algorithm described herein includes steps for cleaning the data to set the way for identifying the RGB ID.

An example how the data may look during the moments a golf ball enters the receptacle is shown below:

| RGB Value R | RGB Value G | RGB Value B | Comment |
|---|---|---|---|
| 0.01 | 0.01 | 0.01 | No ball in receptacle |
| 0.00 | 0.02 | 0.01 | No ball in receptacle |
| 0.01 | 0.02 | 0.01 | No ball in receptacle |
| 0.02 | 0.02 | 0.01 | No ball in receptacle |
| 0.28 | 0.32 | 0.11 | Ball entering but not at rest |
| 1.48 | 1.63 | 0.65 | Ball moving in the receptacle |
| 2.91 | 3.30 | 1.04 | Ball moving in the receptacle |
| 3.34 | 3.81 | 1.16 | Ball almost at rest |
| 3.36 | 3.82 | 1.25 | Ball almost at rest |
| 3.28 | 3.69 | 1.20 | Ball at rest |
| 3.27 | 3.70 | 1.20 | Ball at rest |
| 3.28 | 3.70 | 1.20 | Ball at rest |
| 3.27 | 3.71 | 1.20 | Ball at rest |

The part of the algorithm that rejects so call "dirty" data and ensures only "clean" data is used for RGB ID identification purposes works by analyzing the RGB values and comparing them with immediately preceding ones. Using the 0-5 v scale shown, any RGB Value less than 0.05 v for example indicates no golf ball is present. When a golf ball enters the receptacle the voltages immediately increase. If the latest RGB value for any of R, G or B differs from its previous value by more than 0.05 v for example, the RGB Value is considered "dirty" and rejected. As can be seen above, after a few fractions of a second the RGB values become consistent and are used by the managing computer for identification purposes. Data in this example is being collected every 0.1 s, but this is variable according the managing computer's settings.

If golf balls with different designed dimple patterns and/or of different sizes etc. are used, a new RGB ID dataset would be required following the same process as described in this application.

In accordance with the preferred embodiment, golf ball colors should be selected, not by colors as seen by humans, but with distinct RGB IDs to provide distinct sensor readings and therefore low confusion risk over the four reference intensities.

Application of the System within a Gaming Environment

There are a large number of possibilities for this game and a few are mentioned herein. The present invention is not limited by the examples hereinafter discussed.

First, any number of targets may be placed on the playing field. For instance, a basic game may comprise ten targets situated between 50 and 250 yards from a hitting area. Smaller targets (200 to 400 square feet) using the same design can be placed at 100 yards and less. Still smaller targets (15 to 75 square feet) using the same design can be placed at 50 yards or less (such as in a residential garden). The hitting area 15 may comprise of an area large enough for individual players to safely swing a golf club and hit the ball in the direction of the targets 20. In accordance with a preferred embodiment, the approximate area a single player may require is 40 square feet.

The preferred embodiment game is based on traditional golf without the putting component. Real golf shots using the players own or loaned golf clubs are hit at distant targets 20 and scores are accumulated upon successfully landing a ball in a target.

Targets will either be set up according to the space available or targets will placed in set positions according to a template. The latter will allow players who are individuals and/or teams to compete with equal difficulty against a database of scores or in real-time, including from different locations.

Players and/or teams check-in and receive a bucket containing a set number of golf balls. They may be known during play by the color of their golf balls, or by any information they care to provide which is linked to their color.

Players are provided with a series of targets to aim for represented by their distances from the hitting area. They will either be aimed at in a particular order or not, depending on the type and/or difficulty of the game chosen.

Results and statistics are posted in real-time on displays and the targets light up when a golf ball successfully lands in a target.

When the bucket of balls is empty or after the allotted time for the game is reached, the final statistics are displayed and stored to create a leader board and database of results for comparison and competition among multiple locations.

White balls maybe used for practice. The identification data for white balls will not be stored in the computer. The balls can still be recognized by the sensor as practice balls and the LED light strips along the leading edge of the targets will light up to provide feedback for practicing players. This also allows for people to participate in the game without competing.

Several options are available including games involving only shorter distance targets, for example up to 150 yards, and a more realistic simulation of golf whereby initially one (or two if a simulating a par five hole) long shot is required followed by a shorter shot. Also, a hole in one completion and long drive competition are contemplated.

The management basis for the game is the identification of the ball by its color. The individual and/or team playing the game will be identified by the color of the golf balls they are given at the beginning of the game. The scoring will be based on the data received from color sensors located within the targets which will identify the color of each golf ball landing in the target.

A further embodiment places the targets in accordance with fixed template so that scoring data may be stored and used to enable different locations to compete based on similar levels at difficulty created at different locations at the same or different times. According to the preferred embodiment, all components of the game are preferably portable allowing the game system to be set up temporarily on existing golf courses, at country clubs, driving ranges or other open spaces even just for an afternoon or evening, for example. Low light conditions do not impact the playing of the game due to the ability to provide local lighting as required and the targets are illuminated with the LED (light emitting diodes) lights.

A further embodiment places smaller targets of the same design in smaller playing areas, such as in residential gardens.

What I claim:

1. A target-based leisure gaming system for deploying in a golf-related gaming environment, said leisure gaming system comprising:

a golf target, said golf target including:

an outer frame having a plurality of detachably coupled supporting legs, a landing-area overlay detachably coupled to a top side of the frame, said landing-area overlay having an aperture at a centroid location, a receptacle unit attached to the underside of the landing-area overlay, said receptacle unit attached to a central location of the landing-area overlay, said receptacle unit further including:

a funnel section having one end operatively coupled to said aperture, a delivery tube section having one end operatively coupled to another end of said funnel, a golf-ball receptacle section having an opening operatively coupled to another end of said delivery tube, a color sensor positioned relative to a center of said golf-ball receptacle section, an illuminating source positioned adjacent to the color sensor at an offset position relative to said center of said golf-ball receptacle section, an insertive resilient member operatively coupled to said golf-ball receptacle section, a receptacle processor operatively coupled to said color sensor, said receptacle processor capable of receiving reading signals from said color sensor, processing said reading signals, and generate output signals, an output transmitter for transmitting said generated output signal; and a receiving terminal comprising:

a receiver capable of receiving, from said output transmitter of said receptacle unit, said generated output signal and forwards the received generated output signal to a managing processor, said managing processor capable of further processing the generated output signal to generate display signal, and a display for displaying said generated display signal.

2. The system of claim 1, wherein said frame is made of one of PVC, plastic or metallic material.

3. The system of claim 1, wherein said landing-area overlay is made of one of canvas, vinyl and plastic material.

4. The system of claim 1, wherein said frame is one of polygonal and circular in shape.

5. The system of claim 1, wherein the legs of said golf target are individually adjustable in height.

6. The system of claim 1, wherein the output transmitter transmits said generated output signal to said receiving terminal via wireless transmission.

7. The system of claim 1, wherein said reading signals from color sensor includes red, blue, and green value components.

8. The system of claim 1, wherein one of the receptacle processor and managing processor is capable of identifying a RGB ID of a golf ball based on the reading signals received from the color sensor.

9. The system of claim 1, further comprising at least one lighting element affixed to the frame, wherein said at least one lighting element capable of light illumination in different colors.

10. The system of claim 9, wherein one of said receptacle processor and managing processor is capable of generating lighting signals for controlling the illumination of said at least one lighting element.

11. A target-based leisure gaming system for deploying in a golf-related gaming environment, said leisure gaming system comprising:

a golf target, said golf target including:

an outer frame having a plurality of detachably coupled supporting legs, a landing-area overlay detachably coupled to a top side of the frame, said landing-area overlay having an aperture at a centroid location, a receptacle unit attached to the underside of the landing-area overlay, said receptacle unit attached to a central location of the landing-area overlay, said receptacle unit further including:

means for guiding a golf ball from said aperture to a rest section of said receptacle unit, means for illuminating said receptacle unit, means for detecting red, green, and blue illumination values of light reflected from a golf ball at a rest position in the rest section of said receptacle unit and generating an output signal using said detected red, green, and blue illumination values, means for ejecting said golf ball from said rest position towards an exist opening of said receptacle unit, and means for transmitting output signal to a receiving terminal, said receiving terminal comprising:

means for receiving, from said receptacle unit, said generated output signal, means for further processing the generated output signal to generate display signal, a display for displaying said generated display signal.

12. The system of claim 11, further comprising means for identifying a RGB ID of said golf ball using the detected red, green, and blue illumination values.

13. The system of claim 11, wherein said landing-area overlay is made of one of canvas, vinyl or PVC material.

14. The system of claim 11, wherein said frame is one of polygonal and circular in shape.

15. The system of claim 11, wherein the legs of said golf target are individually adjustable in height.

16. The system of claim 11, wherein said generated output signal is wirelessly transmitted to said receiving terminal.

17. The system of claim 11, further comprising at least one lighting element affixed to the frame, wherein said at least one lighting element capable of light illumination in different colors.

18. The system of claim 17, further comprising means for controlling the color of illumination of said at least one lighting element.

19. The system of claim 11, further comprising means for determining the RGB ID of a colored golf ball using output signal generated from said detected red, green, and blue illumination values.

20. The system of claim 19, wherein said receiving terminal further comprises means for tallying up a score of at least one player of said target-based leisure game using the determined RGB IDs of the golf balls.

* * * * *